US006463985B1

(12) United States Patent
Hsu

(10) Patent No.: US 6,463,985 B1
(45) Date of Patent: Oct. 15, 2002

(54) LOWER BEAM STRUCTURE OF FOLDING BLIND

(75) Inventor: Pey-Son Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 09/859,537

(22) Filed: May 18, 2001

(51) Int. Cl.[7] ..... E06B 3/48
(52) U.S. Cl. ..... 160/84.04; 160/173 R
(58) Field of Search ..... 160/84.04, 84.05, 160/173 R, 178.1 R

(56) References Cited

U.S. PATENT DOCUMENTS 2,592,995 A * 4/1952 Anderle
2,697,487 A * 12/1954 Nelson
2,812,022 A * 11/1957 Lawson
2,861,631 A * 11/1958 Anderle
4,607,677 A * 8/1986 Comeau
4,750,310 A * 6/1988 Holcombe
5,918,656 A * 7/1999 Daniels et al.
6,062,292 A * 5/2000 Bryant

* cited by examiner

*Primary Examiner*—Blair M. Johnson
(74) *Attorney, Agent, or Firm*—Troxell Law Office PLLC

(57) ABSTRACT

Lower beam structure of folding blind including a folding slat assembly, several press bodies, a shade slat, a lower beam and two lateral plugs. Several pull cords are sequentially passed through the folding slat and the top ends of the pull cords are fixed on an upper beam. The press body is a rectangular body formed with a central through hole. Two lateral edges of the press body are cut with opposite snap notches. Two opposite sides of the press body are formed with two guide slopes respectively having two guide cut faces on opposite corners. The shade slat is overlaid on the top face of the lowest folding slat and the pull cord is wound in the snap notches of the press body. The press body and the shade slat are together placed into the lower beam and then the press body is turned to press and firmly locate the shade slat, the lowest folding slat and the pull cord.

4 Claims, 4 Drawing Sheets

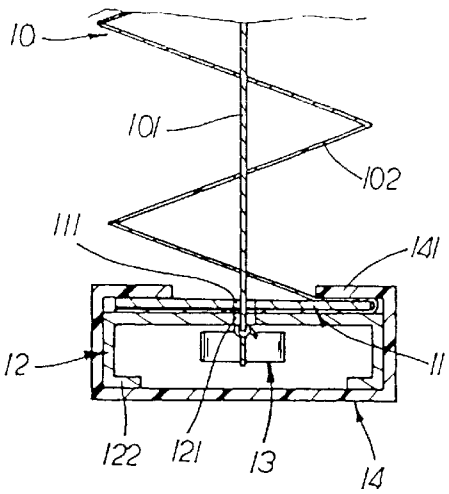
FIG. 2
PRIOR ART
FIG. 1
PRIOR ART
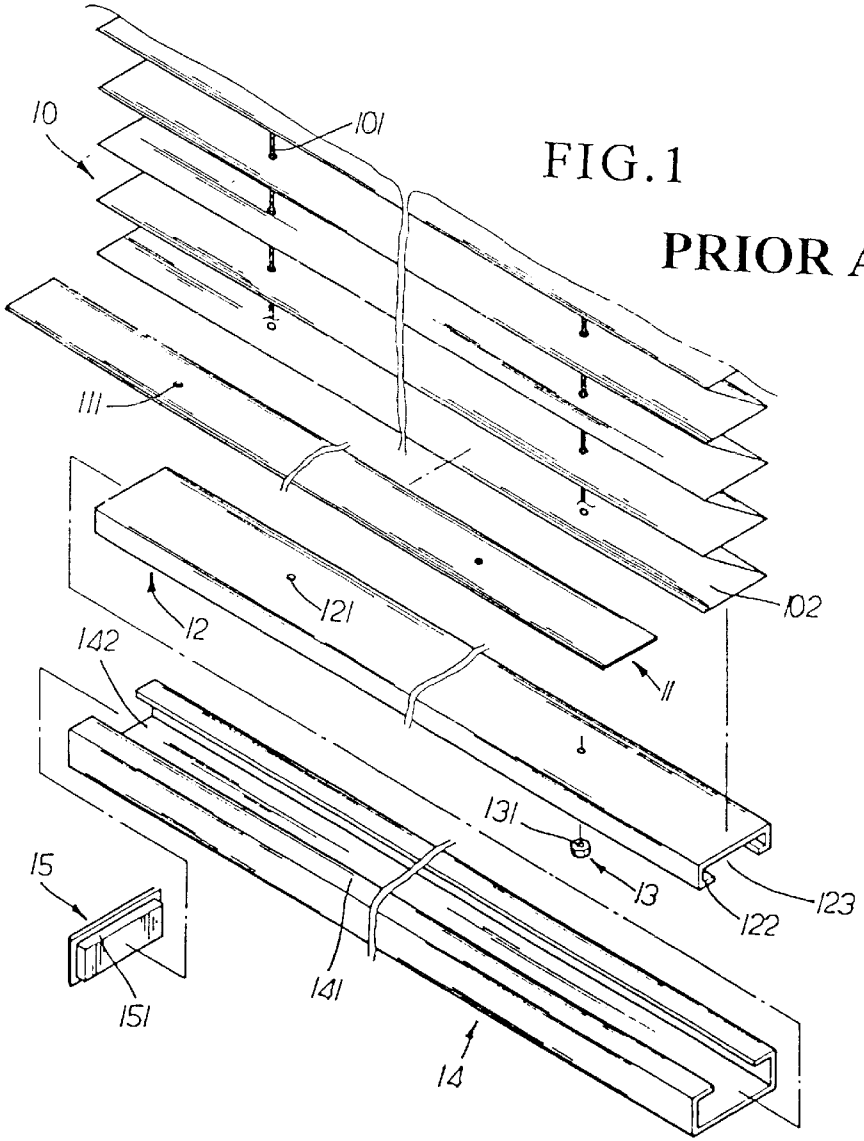

LOWER BEAM STRUCTURE OF FOLDING BLIND

BACKGROUND OF THE INVENTION

The present invention is related to a lower beam structure of folding blind, which has less components so that the cost for the material and the molds is reduced and the manufacturing procedure is simplified and speeded. In addition, the assembling procedure of the lower beam structure is simplified and speeded so that mass-production is possible. After assembled, a press body exerts a downward pressure onto the folding slat and the shade slat so that the folding slat and the shade slat are prevented from slipping out of the lower beam and are more firmly located.

FIG. 1 shows the lower beam structure of a conventional folding blind including a folding slat assembly 10, a shade slat 11, an inner fitting bar 12, several connecting bodies 13, a lower beam 14 and two lateral plugs 15. Several pull cords 101 are sequentially passed through the folding slat 102. The top ends of the pull cords 101 are fixed on the upper beam (not shown). The shade slat 11 has a length equal to that of the folding slat 102. The shade slat 11 is formed with several cord holes 111 corresponding to the pull cords 101. The inner fitting bar 12 has a reverse U-shaped cross-section and a length equal to that of the folding slat 102. The horizontal section of the inner fitting bar 12 is formed with several cord holes 121 corresponding to the pull cords 101. The ends of the vertical sections of the inner fitting bar 12 are inward bent to form two retaining legs 122 with a certain width. The two retaining legs 122 define therebetween a receiving channel 123. The connecting body 13 is a circular block formed with a cord hole 131. The lower beam 14 has a U-shaped cross-section and a certain length. The ends of the vertical sections of the lower beam 14 are inward bent to form two stop strips 141 with a certain width. The two stop strips 141 define therebetween a receiving slide channel 142. The lateral plug 15 is a stepped body having a small dimension section serving as a plug section 151.

When assembled, as shown in FIG. 2, the shade slat 11 is first overlaid on the top face of the lowest folding slat 102. The pull cord 101 is passed through the cord hole 111 to extend from bottom face of the lowest folding slat 102 by a certain length. Then, the extending pull cord 101 is further passed through the cord hole 121 of the inner fitting bar 12 and the cord hole 131 of the connecting body 13 and tied on the connecting body 13. At this time, by means of the stop of the connecting body 13, the pull cord 101 is prevented from detaching from the cord holes 121, 111 of the inner fitting bar 12 and the shade slat 11. The connecting body 13 is restricted and received in the receiving channel 123 of the inner fitting bar 12. Then, the shade slat 11, inner fitting bar 12 and the connecting body 13 are together fitted into the receiving slide channel 142 of the lower beam 14. The shade slat 11 is stopped by the stop strips 141 from upward separating from the lower beam 14. Also, the lowest folding slat 102 is sandwiched between the shade slat 11 and the inner fitting bar 12 and preliminarily located. Finally, the plug sections 151 of the two lateral plugs 15 are plugged into two ends of the receiving slide channel 142 of the lower beam 14 to complete the assembly.

The above conventional structure has some shortcomings as follows:

1. The structure has numerous components. In addition, the inner fitting bar 12 has a considerable length equal to that of the folding slat 102. Therefore, the cost for the material of such structure is relatively high.

2. The numerous components necessitate more molds so that the cost for the molds is increased. Moreover, the shade slat 11 and the inner fitting bar 12 are formed with several cord holes 111, 121. This complicates the manufacturing procedure.
3. When assembled, the pull cord 101 is first passed through the cord hole 111 of the shade slat 11 and then passed through the cord hole 121 of the inner fitting bar 12 and tied on the connecting body 13. Finally, the shade slat 11, inner fitting bar 12 and the connecting body 13 are together fitted into the lower beam 14 for restricting and fixing the folding slat 102. These assembling steps are complicated and will lower the production efficiency. Therefore, it is impossible to mass-produce the folding blind.
4. The folding slat 102, shade slat 11 and inner fitting bar 12 are transversely fitted into the lower beam 14. Thereafter, they can freely transversely slide within the lower beam without restriction. It often takes place that they slip out of the lower beam 14 so that a user often needs to reassemble these components.

SUMMARY OF THE INVENTION

It is therefore a primary object of the present invention to provide a lower beam structure of folding blind, which has less components so that the entire structure is simplified and the cost for the material is reduced.

It is a further object of the present invention to provide the above lower beam structure in which the components are simplified so that the cost for the molds is reduced. Moreover, it is unnecessary to form any cord hole on the shade slat so that the manufacturing procedure is simplified and speeded.

It is still a further object of the present invention to provide the above lower beam structure the assembling procedure of which is simplified and speeded and so that mass-production is possible.

It is still a further object of the present invention to provide the above lower beam structure in which after located, the press body exerts a downward pressure onto the folding slat and the shade slat, whereby the folding slat and the shade slat are prevented from freely sliding within the lower beam. Therefore, the folding slat and the shade slat will not slip out of the lower beam and it is unnecessary to frequently reassemble the components.

It is still a further object of the present invention to provide the above lower beam structure in which when the pull cord is wound in the snap notches of the press body, the pull cord is engaged in the snap notches and preliminarily fixed with the press body. Accordingly, when assembled, the pull cord is prevented from freely detaching from the press body. Therefore, the assembling procedure is facilitated and speeded.

It is still a further object of the present invention to provide the above lower beam structure in which the press body is not only applicable to single-layer folding blind, but also applicable to double-layer folding blind. Therefore, the application range is wider.

The present invention can be best understood through the following description and accompanying drawings wherein:

BRIEF DESCRIPTION OF THE DRAWINGS

FIG. 1 is a perspective exploded view of a lower beam structure of a conventional folding blind;

FIG. 2 is a sectional assembled view of the lower beam structure of the conventional folding blind;

DETAILED DESCRIPTION OF THE PREFERRED EMBODIMENTS

Figure 3:
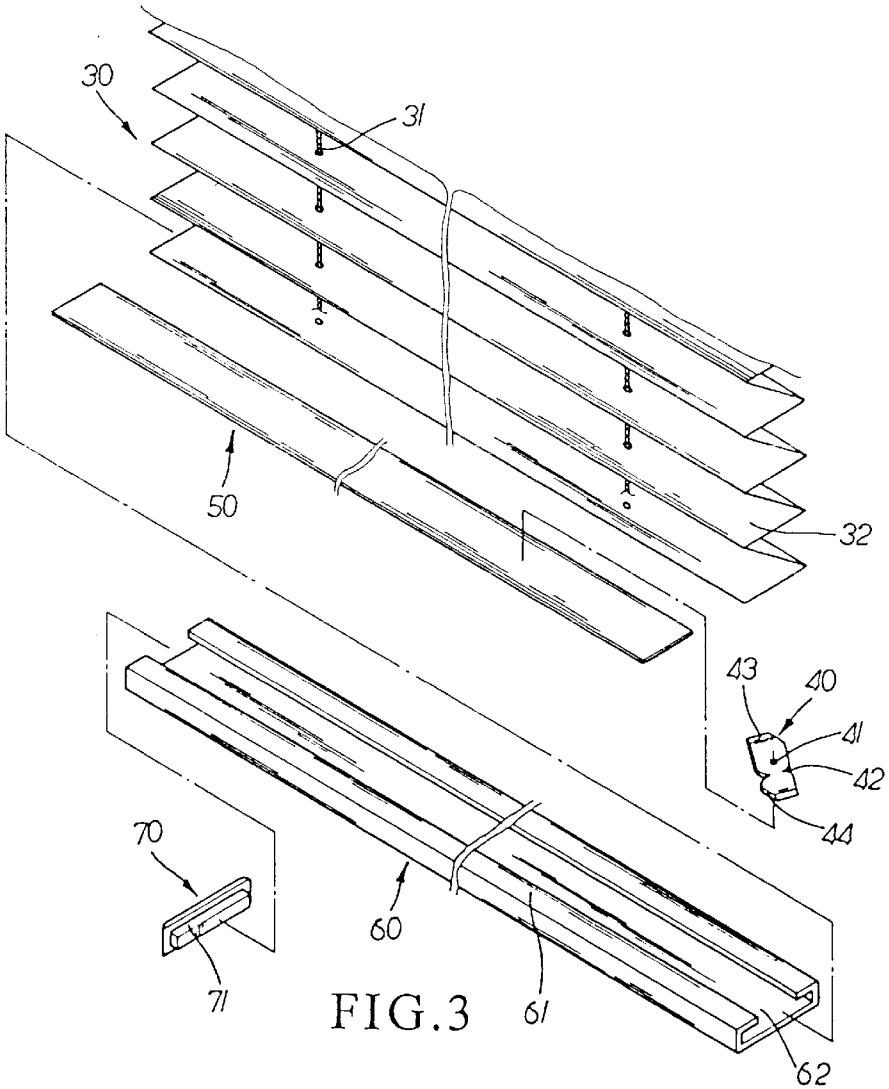
FIG. 3 is a perspective exploded view of the lower beam structure of the present invention.

Please refer to FIG. 3. The lower beam structure of folding blind of the present invention includes a folding slat assembly 30, several press bodies 40, a shade slat 50, a lower beam 60 and two lateral plugs 70. Several pull cords 31 are sequentially passed through the folding slat 32. The top ends of the pull cords 31 are fixed on the upper beam (not shown). The press body 40 is a rectangular body with a certain dimension. The press body 40 is formed with a central through hole 41. Two lateral edges of the press body 40 are cut with opposite snap notches 42 on one side of the through hole 41. In addition, two opposite sides of the press body 40 are formed with two guide slopes 43 respectively having two guide cut faces 44 on opposite corners. The shade slat 50 has a length equal to that of the folding slat 32. The lower beam 60 has a U-shaped cross-section and a certain length. The top ends of the vertical sections of the lower beam 60 are integrally inward bent to form two stop strips 61 with a certain width. The two stop strips 61 define therebetween a receiving slide channel 62. The lateral plug 70 is a stepped body having a small dimension section serving as a plug section 71.

Figure 4:
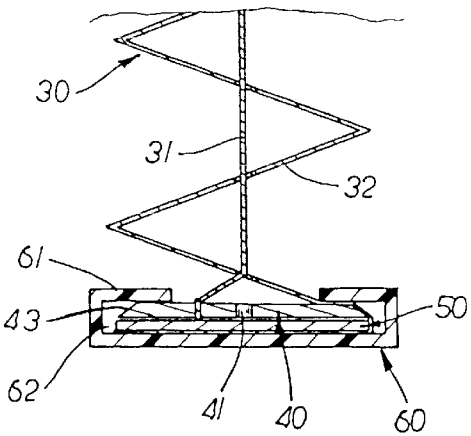
FIG. 4 is a sectional assembled view of the lower beam structure of the present invention.
Figure 5:
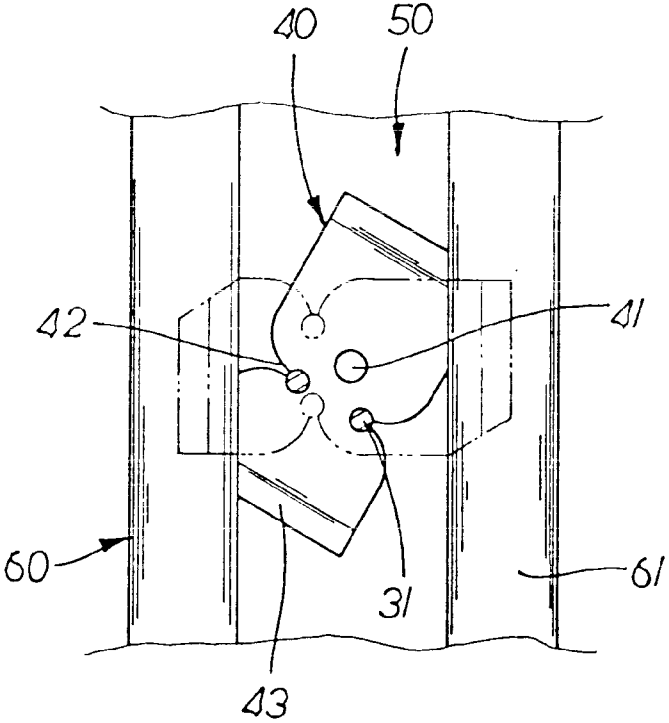
FIG. 5 shows that the press body of the present invention is turned to press the pull cord.

When assembled, as shown in FIGS. 4 and 5, the shade slat 50 is first overlaid on the top face of the lowest folding slat 32. The pull cord 31 is-not passed through the lowest folding slat 32 and is wound and fixed in the snap notches 42 of the press body 40 by a certain length. Under such circumstance, the pull cord 31 is wound in the snap notches 42 and preliminarily fixed with the press body 40. Therefore, when assembling the press body 40, the pull cord 31 is prevented from freely detaching from the press body 40. Then, the folding slat 32, the press body 40 and the shade slat 50 are together fitted into the receiving slide channel 62 of the lower beam 60. After completely fitted, by means of the guiding of the guide cut faces 44, the press. body 40 is quickly inserted into the small gap between the stop strips 61 and the shade slat 50. At the same time, a rotating force is applied to the press body 40 to make the press body 40 turn from an oblique position to a parallel position. When turning, by means of the guide slopes 43, the press body 40 can be smoothly rotated. The guide slope 43 has only a certain length so that when the press body 40 is totally rotated to a fixed position, the stop strips 61 will downward press the top faces of two lateral sides of the press body 40 against the shade slat 50 and the lowest folding slat 32. Therefore, the shade slat 50 and the lowest folding slat 32 are prevented from freely horizontally sliding within the lower beam 60. Moreover, the downward pressing force is applied to the pull cord 31 to more firmly fix the pull cord 31 with the press body 40. Finally, the plug sections 71 of the two lateral plugs 70 are plugged into two ends of the receiving slide channel 62 of the lower beam 60 to complete the assembly.

Figure 6:
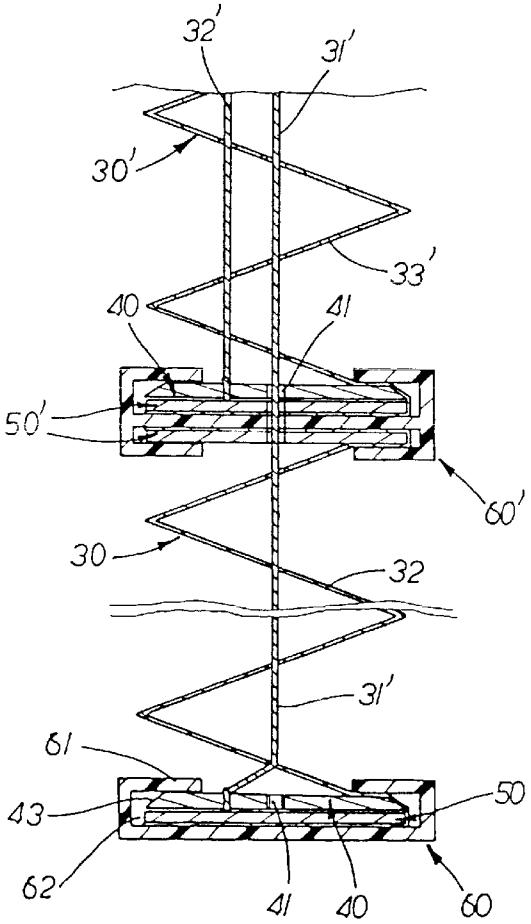
FIG. 6 shows that the present invention is applied to a double-layer folding blind.

The above press body 40 is also applicable to double-layer folding blind as shown in FIG. 6. The subsidiary pull cord 32' of the upper folding slat assembly 30' is wound and fixed in the snap notches 42 of the press body 40. The main pull cord 31' of the upper folding slat assembly 30' is passed through the through hole 41 of the press body 40, the through hole of a middle beam 60' and the through hole of a middle beam shade slat 50' to extend out from the bottom face of the middle beam 60' by a certain length. Also, the lowest slat 33' of the upper folding slat assembly 30', the press body 40 and the middle beam shade slat 50' are together fitted into the top end of the middle beam 60'. The press body 40 is rotated by a certain angle to complete the assembly of the upper folding slat assembly 30'. In addition, the top end of the folding slat assembly 30 and another middle beam shade slat 50' are together fitted into the bottom end of the middle beam 60'. Also, the main pull cord 31' is passed through the through holes of the middle beam shade slat 50' and the folding slat assembly 30 to extend onto the lowest folding slat 32. Then, according to the preceding steps, the main pull cord 31' is wound in the snap notches 42 of the press body 40. Then, the lowest folding slat 32, the press body 40 and the shade slat 50 are together fitted into the receiving slide channel 62 of the lower beam 60. After completely fitted in, the press body 40 is rotated by a certain angle to complete the assembly.

Figure 7:
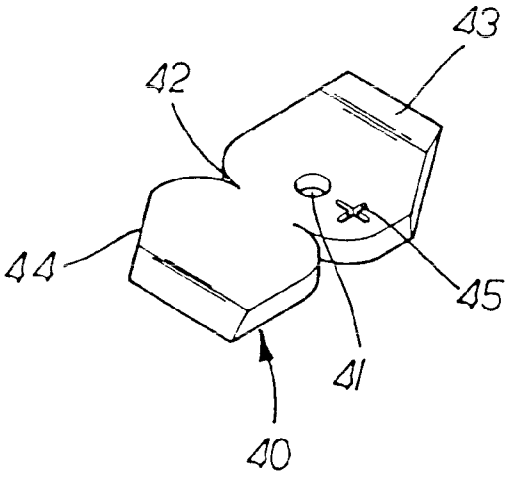
FIG. 7 shows another embodiment of the present invention.

According to another embodiment of the present invention, when molded, one side of top face of the press body 40 is directly formed with a cross-shaped channel or a straight channel 45 as shown in FIG. 7. When assembled, a cross screwdriver or a flat head screwdriver can be fitted into the cross-shaped channel or a straight channel 45 to help in turning the press body 40. Accordingly, the assembling procedure can be facilitated and speeded.

Figure 8:
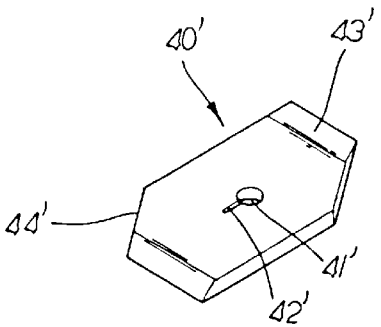
FIG. 8 shows still another embodiment of the present invention.

FIG. 8 shows still another embodiment of the present invention, in which the lateral sides of the press body 40 are free from any snap notch. Instead, a snap split 42' is formed on the press body 40' and adjacent to the through hole 41' thereof. The width of the snap split 42' is slightly smaller than the outer diameter of the pull cord 31. When assembled, the pull cord 31 is first passed through the through hole 41' and pulled into the snap split 42' and fixed therein. This also achieves a preliminarily locating effect for the press body 40'.

Figure 9:
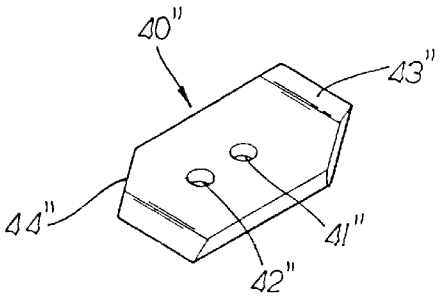
FIG. 9 shows still another embodiment of the present invention.

FIG. 9 shows still another embodiment of the present invention, in which the lateral sides of the press body 40 are free from any snap notch. Instead, a cord winding hole 42" is formed on the press body 40" beside the through hole 41" thereof. When assembled, the pull cord 31 is first passed through the through hole 41" and then reversely conducted through the cord winding hole 42" to extend out from the top face of the press body 40" by a certain length. After the press body 40" is rotated and located, the pull cord 31 is conducted through the through hole 41" and the cord winding hole 42" and pressed by the press body 40" and firmly located.

According to the above arrangements, the present invention has the following advantages:

1. The structure has less components and the press body 40 is a short body so that the entire structure is simplified and the cost for the material is reduced.
2. The components are simplified so that the cost for the molds is reduced. Moreover, it is unnecessary to form any cord hole on the shade slat 50 so that the manufacturing procedure is simplified and speeded.

3. When assembled, the pull cord 31 is wound in the snap notches 42 of the press body 40 and then the shade slat 50 and the press body 40 are together placed into the lower beam 60. Then the press body 40 is turned by a certain angle. Such procedure can be easily performed so that the assembling procedure is simplified and speeded and mass-production is possible.
4. After located, the press body 40 exerts a downward pressure onto the folding slat 32 and the shade slat 50, whereby the folding slat 32 and the shade slat 50 are prevented from freely sliding within the lower beam 60. Therefore, the folding slat 32 and the shade slat 50 will not slip out of the lower beam 60 and it is unnecessary to frequently reassemble the components.
5. When the pull cord 31 is wound in the snap notches 42 of the press body 40, the pull cord is engaged in the snap notches 42 and preliminarily fixed with the press body 40. Accordingly, when assembled, the pull cord 31 is prevented from freely detaching from the press body 40. Therefore, the assembling procedure is facilitated and speeded.
6. The press body 40 is not only applicable to single-layer folding blind, but also applicable to double-layer folding blind. Therefore, the application range is wider.

The above embodiments are only used to illustrate the present invention, not intended to limit the scope thereof. Many modifications of the above embodiments can be made without departing from the spirit of the present invention.

What is claimed is:

1. A lower beam structure for a folding blind comprising a folding slat assembly, a plurality of press bodies, a shade slat, a lower beam and two lateral plugs, a plurality of pull cords sequentially passed through the folding slat assembly, top ends of the pull cords being fixed on an upper beam, the shade slat having a length equal to that of the folding slat assembly, the lower beam having a U-shaped cross-section, top ends of vertical sections of the lower beam being directly inwardly bent to form two stop strips, the two stop strips defining therebetween a receiving slide channel, the two lateral plugs being stepped bodies each having a section serving as a plug section, said lower beam structure being characterized in that each press body is rectangular, two opposite sides of the press body being formed with guide slopes respectively having two guide cut faces on opposite corners, whereby the shade slat is overlaid on a top face of a lowest folding slat of the folding slat assembly, the pull cord being wound on the press body, the press body and the shade slat being together placed into the receiving slide channel of the lower beam, the press body being turned by a predetermined angle to exert a downward pressure onto the shade slat, the lowest folding slat and the pull cord so as to assemble the components of the folding blind.

2. The lower beam structure of a folding blind as claimed in claim 1, wherein the press body has a central through hole and two lateral edges of the press body have snap notches on one side of the through hole.

3. The lower beam structure of a folding blind as claimed in claim 1, wherein a snap split is formed on the press body adjacent to a through hole thereof, a width of the snap split being smaller than an outer diameter of each of the pull cords, whereby when assembled, one of the pull cords is first passed through the through hole, pulled into the snap split and fixed therein so as to preliminarily fix the pull cord with the press body.

4. The lower beam structure of a folding blind as claimed in claim 1, wherein a cord winding hole is formed on the press body beside a through hole thereof, whereby when assembled, one of the pull cords is first passed through the through hole and then reversely passed through the cord winding hole to extend out from a top face of the press body by a predetermined length, such that, after the press body is rotated and located, the pull cord passed through the through hole and the cord winding hole is pressed by the press body and firmly located.

* * * * *